US005690437A

United States Patent [19]

Yanagisawa et al.

[11] Patent Number: 5,690,437

[45] Date of Patent: Nov. 25, 1997

[54] METHOD AND APPARATUS FOR CONTROLLING THE THERMAL HEAD DRIVE

[75] Inventors: Shigekazu Yanagisawa; Susumu Takatsu, both of Suwa; Kenji Watanabe, Tokyo; Takanobu Kameda, Tokyo; Chieko Aida, Tokyo; Tomoyuki Shimmura, Tokyo, all of Japan

[73] Assignee: Seiko Epson Corporation, Tokyo, Japan

[21] Appl. No.: 566,209

[22] Filed: Dec. 1, 1995

[30] Foreign Application Priority Data

| | | | |
|---|---|---|---|
| Dec. 2, 1994 | [JP] | Japan | 6-299599 |
| Nov. 10, 1995 | [JP] | Japan | 7-292817 |

[51] Int. Cl.[6] ..... B41J 2/365

[52] U.S. Cl. ..... 400/120.14; 347/189

[58] Field of Search ..... 400/54, 74, 719, 400/615.2, 120.14; 347/189

[56] References Cited

U.S. PATENT DOCUMENTS

| | | | |
|---|---|---|---|
| 4,590,362 | 5/1986 | Ishima | 347/189 |
| 4,591,876 | 5/1986 | Nozaki et al. | 347/189 |
| 4,814,787 | 3/1989 | Doi | 347/189 |
| 5,331,340 | 7/1994 | Sukigara | 346/76 PH |
| 5,453,765 | 9/1995 | Yamaguchi et al. | 347/179 |

FOREIGN PATENT DOCUMENTS

| | | | |
|---|---|---|---|
| 0 346 833 | 12/1989 | European Pat. Off. | 400/54 |
| 0 461 936 | 12/1991 | European Pat. Off. | 346/1.1 |
| 62-23767 | 1/1987 | Japan | 400/120.14 |
| 62-121072 | 6/1987 | Japan | 400/120.09 |
| 64-14055 | 1/1989 | Japan | 400/120.14 |
| 2-2030 | 1/1990 | Japan | 400/120.14 |
| 2-25345 | 1/1990 | Japan | 400/120.14 |
| 2-9649 | 1/1990 | Japan | 400/120.14 |
| 2-45182 | 2/1990 | Japan | 400/120.14 |
| 2-121853 | 5/1990 | Japan | 400/120.14 |

*Primary Examiner*—Edgar S. Burr
*Assistant Examiner*—Steven S. Kelley
*Attorney, Agent, or Firm*—Mark P. Watson

[57] ABSTRACT

The present invention provides a method and an apparatus for driving and controlling a thermal head used in a printing device, such as a tape printer, in response to the temperature variations of the printing device environment and the thermal head. According to the present invention, in the printing operation of the tape printer, measurements are made of the initial temperature T1 immediately after the power is switched on, the temperature prior to printing T2, and the ambient temperature of the thermal head each time the thermal head prints T3 (i). If the temperature difference between the initial temperature T1 and the temperature prior to printing T2 is small, the duration of the current signals provided to the thermal head is controlled in accordance with the temperature prior to printing T2, which is the most recently measured thermal head ambient temperature best reflecting the printing device environmental temperature. If the difference is large, the duration is controlled in accordance with the initial temperature T1 which then best reflects the environmental temperature. If the rate of the increase in temperature during printing T3(i) is large, the duration is controlled in accordance with the initial temperature T2 to reduce the duration. If the temperature during printing T3(i) exceeds a temperature which indicates overheating, the printing operation is aborted. Thus, the present invention allows for controlling the thermal head drive by means of the measured thermal head temperature excluding the effect of the heat generation of the thermal head and in accordance with the thermal state of the thermal head.

27 Claims, 8 Drawing Sheets

FIG.−8

| PARAMETER / CARTRIDGE | ① HEAD DRIVE MODE | ② PRINT SPEED |
|---|---|---|
| 6(mm) | ONE TIME PRINTING | 15(mm/sec) |
| 9 | ONE TIME PRINTING | 15 |
| 12 | PRINTING IN TWO TIMES | 15 |
| 18 | PRINTING IN THREE TIMES | 10 |
| 24 | PRINTING IN THREE TIMES | 7 |

FIG.—12

VOLTAGE OF POWER SUPPLY

| PARAMETER / CARTRIDGE | PRINT SPEED | | |
|---|---|---|---|
| | V0≥A(V) | A>V0≥B(v) | B>V0≥C(v) |
| 6(mm) | 15(mm/sec) | 10(mm/sec) | 7(mm/sec) |
| 9 | 15 | 10 | 7 |
| 12 | 15 | 10 | 7 |
| 18 | 10 | 10 | 7 |
| 24 | 7 | 7 | 7 |

V0 : MEASURED VOLTAGE
A,B,C : SWITCH VOLTAGES

FIG.—13

METHOD AND APPARATUS FOR CONTROLLING THE THERMAL HEAD DRIVE

BACKGROUND OF THE INVENTION

1. Field of the Invention

This invention relates generally to a method and an apparatus for driving and controlling a thermal head used in a printing device such as a tape printer for printing on a tape recording medium. More particularly, the present invention relates to a method and an apparatus for properly driving and controlling a thermal head in response to the temperature variations of the environment and the thermal head.

2. Description of the Related Art

In recent years, printing devices which print on tape recording media have become very popular. Such tape recording media have on their backs an adhesive layer which is covered with peel-off tape. After printing, the paper is peeled off and the tape is affixed to a desired place such as a label. Since this kind of printing device (referred to as the tape printer in the present specification) must be small and compact, the printing mechanism used in the printer must also be small. A typical tape printer employs a thermal transfer printing mechanism including a thermal head.

When the thermal head is in use, the power provided to each heating element must be adjusted accorded to the temperature of the thermal head. The methods for adjusting the power are disclosed in the following Japanese patent laid-open publications:

Japanese Patent Laid-Open Publication SHO 62-121072 discloses a method for controlling the pulse width applied to the thermal head in correspondence with the radiating plate temperature which is measured on every printing operation.

Japanese Patent Laid-Open Publication SHO 64-14055 discloses a method for controlling the thermal head drive by measuring the temperature of a thermistor placed near the thermal head and predicting the temperature change of the thermal head.

Japanese Patent Laid-Open Publication HEI 2-2030 discloses a method in which printing is temporarily suspended if the temperature of the thermal head, when printing ends, is significantly different from that when printing started.

Japanese Patent Laid-Open Publication HEI 2-9649 discloses a method in which the conditions for suspending the head drive change according to the rate of the temperature change of the unit on which the thermal head is mounted.

Japanese Patent Laid-Open Publication HEI 2-25345 discloses a method for driving the thermal head by obtaining the temperature gradient near the thermal head and calculating the temperature of the thermal head from this temperature gradient.

Japanese Patent Laid-Open Publication HEI 2-45182 discloses a method for detecting cooling fan anomaly (overheat) based on the initial temperature and the temperature during printing of the thermal head. In thermal head printing, the condition of the ink ribbon used for thermal transfer changes according to the temperature of the printing device environment. In other words, the quality of the printed dots changes. Therefore, in order to maintain a good print quality, the heat generation of each heating element of the thermal head must be controlled in conjunction with the temperature of the printing device environment.

Japanese Patent Laid-Open Publication SHO 62-23767 discloses a method for controlling the thermal head drive using one sensor for measuring the temperature of the thermal head and another for measuring the ambient temperature.

Japanese Patent Laid-Open Publication HEI 2-121853 discloses a method for controlling the thermal head drive in which the ambient temperature is measured every time the initial setting of the printer is made and then compared with the previous measurement. The driving power provided to the thermal head is calculated according to a predetermined computation procedure. Then, the thermal head is driven according to the result of the computation.

In Japanese Patent Laid-Open Publication SHO 62-23767 above, two temperature sensors are required. Hence this method is not appropriate to a tape printer which must be small and compact as mentioned above.

If a temperature sensor such as a thermistor is placed near the thermal head in Japanese Patent Laid-Open Publication HEI 2-121853 above, the sensor may not be able to measure the temperature of the printing device environment accurately because of the heat generated by the thermal head. This may make it difficult to control the thermal head drive. The reason is that the thermal head becomes a heat source when it operates. Therefore, the temperature measured with the thermistor installed near the thermal head may be quite different from the actual temperature of the printing device environment. For example, even if the temperature of the printing device environment does not change, the temperature measured before the thermal head begins operating is different from that measured after printing is completed. Thus, it is not possible to control the thermal head drive properly according to the environmental temperature alone.

The present invention intends to overcome the problems described above.

SUMMARY OF THE INVENTION

An object of the present invention, therefore, is to provide a method and an apparatus for controlling the thermal head drive according to the environmental temperature measured with a single temperature sensor. The temperature sensor is placed near the thermal head but the present invention operates to exclude the effect of the heat generation from the thermal head.

In order to solve the above problems, the present invention provides a method for controlling the thermal head drive of a printing device wherein the ambient temperature of the thermal head is measured and the duration of the current signal provided to the heat elements of the thermal head is controlled in accordance with the measured ambient temperature. According to the method of the invention, first the ambient temperature of the thermal head is measured immediately after the power to the printing device is switched on, the measured temperature being referred to as the initial temperature T1; secondly, the ambient temperature of the thermal head is measured just before the thermal head starts printing on a recording medium, the measured temperature being referred to as the temperature prior to printing T2; then, the temperature difference between the initial temperature T1 and the temperature prior to printing T2 is calculated; and if the temperature difference is less than a predetermined first threshold value Ta, the duration of the current signals provided to the heat elements of the thermal head is controlled in accordance with the temperature prior to printing T2.

According to this method, the ambient temperature of the thermal head is considered to be the same as the temperature of the printing device environment because the difference between the initial temperature and the temperature prior to printing is small. Therefore, the temperature prior to printing can be used as the most recent thermal head ambient temperature best reflecting the printing device environmental temperature and can be used to control the duration of current signals to the heat elements of the thermal head.

According to the present invention, if the above temperature difference exceeds the predetermined first threshold value Ta, the duration of the current signals provided to the heat elements of the thermal head is controlled in accordance with the initial temperature T1. Thus, if the temperature difference between the initial temperature T1 and the temperature prior to printing T2 is large, the thermal head is considered to be preheated or to have just finished printing. According to the present invention, if it is determined that the temperature T2 does not reflect the printing device environmental temperature, the initial temperature T1 is used as best reflecting the printing device environmental temperature and used to control the duration of the current signals to the heat elements of the thermal head.

Further, according to the present invention, the ambient temperature of the thermal head T3(i), with i being a positive integer, is also measured each time the thermal head prints on a recording medium;

The temperature difference between the measured ambient temperature during printing T3(i+1) and the temperature during printing T3(i) which was measured on the previous printing is calculated; and, if the calculated temperature difference exceeds a predetermined value Tb, the duration of the current signals provided to the heat elements of the thermal head is controlled in accordance with the temperature prior to printing T2.

According to this method, when the thermal head is overheating, the duration of the current signals provided to the thermal head is controlled in accordance with the temperature prior to printing T2, which is normally higher than the initial temperature T1. This operation typically suppresses the heat generation of the thermal head, which prevents the thermal head from overheating.

If the measured temperature during printing T3(i) exceeds the predetermined value Tc, the printing operation is aborted. This causes the overheated thermal head to cease operating.

It is desirable to store the initial temperature T1 for a predetermined period of time after the power to the printing device is turned off. With this feature, even if the power is switched back on before the thermal head has cooled sufficiently, the stored initial temperature can still be used as the initial temperature which is not affected by the heat generation of the thermal head.

According to the apparatus of the present invention, the circuit that measures the ambient temperature of the thermal head includes a thermistor as a temperature sensor and an A/D converter for measuring the output voltage of the thermistor. It is preferable to use a common voltage for both the drive voltage of the thermistor and the reference voltage for the A/D converter because this configuration prevents the output of the thermistor from changing even if the drive voltage drops in the case of battery operation. The apparatus also includes a CPU that calculates the difference between temperatures T1 and T2. The CPU controls the operations of the various steps in the method of the present invention.

Other objects and attainments together with a fuller understanding of the invention will become apparent and appreciated by referring to the following description and claims taken in conjunction with the accompanying drawings.

BRIEF DESCRIPTION OF THE DRAWINGS

FIG. 11A shows the conventional method; FIG. 11B shows a method according to the present invention; and FIG. 11C shows another method according to the present invention.

FIG. 12 shows the relationships between the tape width, the thermal head drive, and the print speed.

FIG. 13 shows the relationships between the tape width, the voltage of the power supply, and the print speed.

DESCRIPTION OF THE PREFERRED EMBODIMENTS

Figure 1:
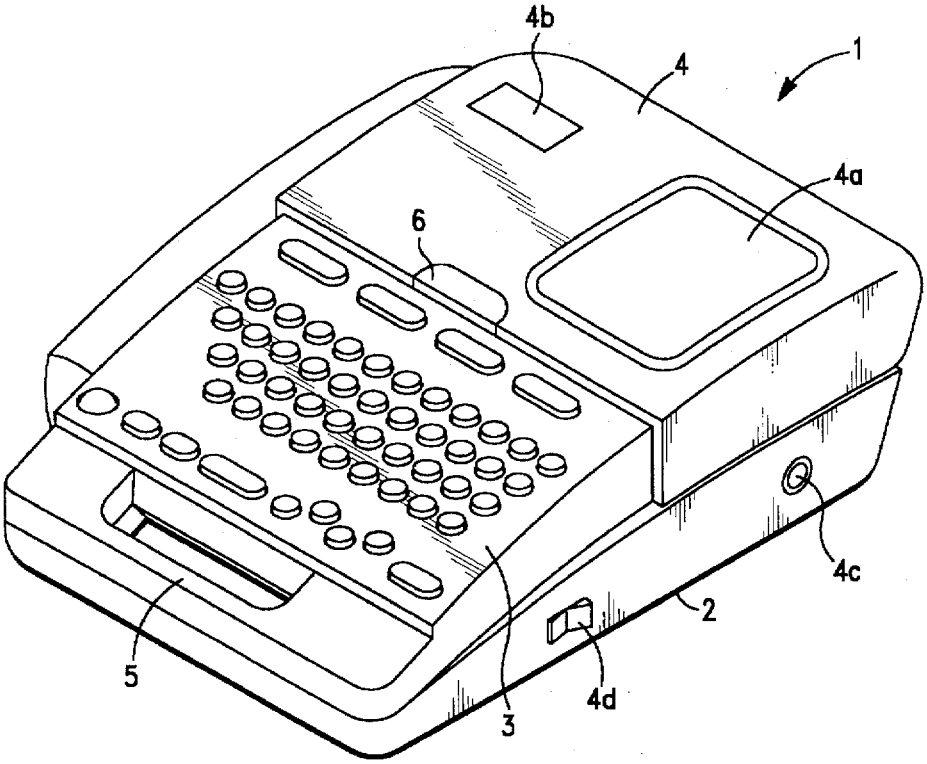
FIG. 1 shows a perspective view of the tape printer according to the present invention.

A detailed description of the present invention for controlling the thermal head drive, as applied to a tape printer, is given below with reference to the accompanying drawings. In the drawings, like reference numerals refer to the like elements.

FIG. 1 is an external view of the tape printer of the present embodiment. A tape printer 1 has a structure similar to a conventional tape printer and includes a case 2, a keyboard 3 on top of it, and a cover 4 with hinges at the rear which opens and closes. A handle 5 is formed in the front part of case 2. Pushing an open button 6 at the center opens cover 4. Cover 4 includes, on one side, a window 4*a* through which the liquid crystal display located inside is viewed and another window 4*b*, on the other side, through which a tape cartridge inserted in the cartridge compartment is seen (see FIG. 2).

On one side of case 2 are an AC adapter socket 4*c* in the rear and a power switch 4*d* in the front. A battery compartment (not shown) is formed inside case 2, and batteries can be installed or replaced by opening a back cover of case 2. This configuration is the same as the conventional tape printer.

Figure 2:
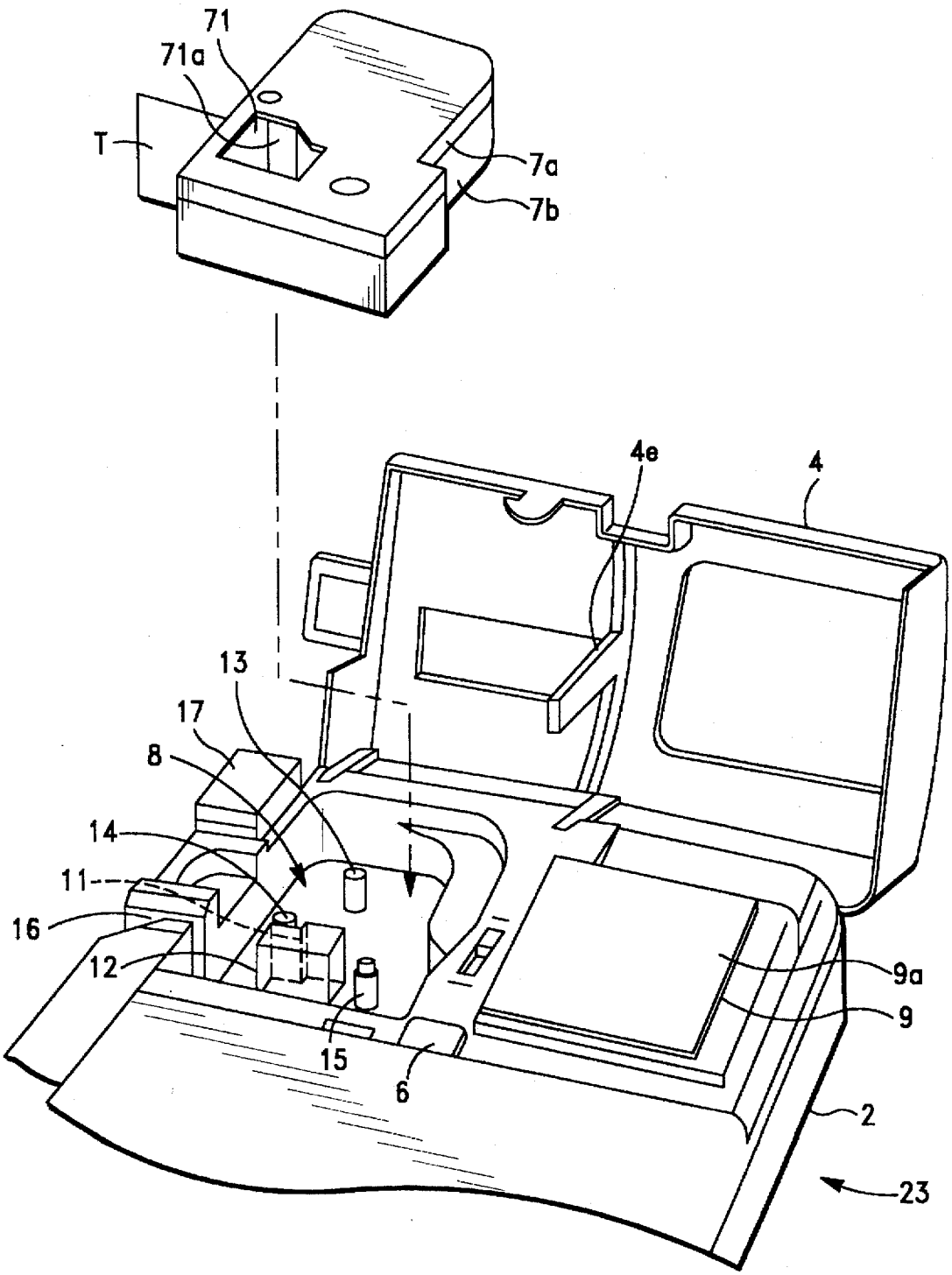
FIG. 2 shows an inside view of the tape printer according to the present invention after the tape cartridge is taken out.

FIG. 2 shows the view as seen when cover 4 is opened. When cover 4 is opened, a compartment 8 for a tape cartridge 7 formed in case 2 is exposed. At the same time a display screen 9*a* of a liquid crystal display 9, placed next to cartridge compartment 8, is also exposed.

Figure 3:
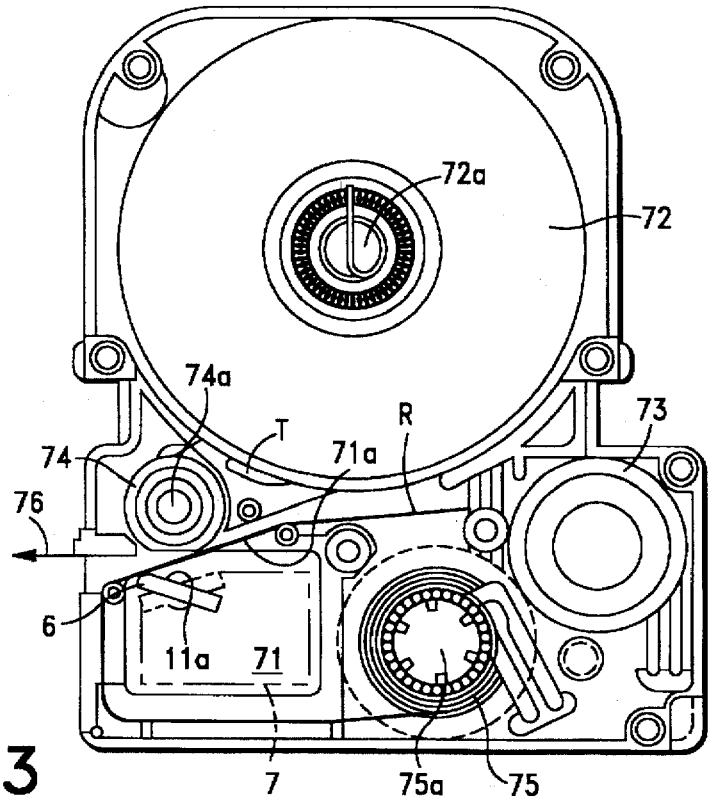
FIG. 3 is a schematic diagram showing the inside of the tape cartridge.

First, the structure of detachable tape cartridge 7 is described with reference to FIGS. 2 and 3. The case of tape cartridge 7 comprises an upper case 7*a* and a lower case 7*b*.

A through hole for the thermal head is formed through both of the cases. Tape cartridge 7 contains a roller 72 for tape recording medium T (referred to as tape hereinafter) and a roller 73 for an ink ribbon. It also contains a platen roller 74 and a ribbon winding roller 75. The tape T rolled out from tape roller 72 runs along the path shown as a bold broken line in FIG. 3 and exits through an opening 76 on one side of the case. The ink ribbon R runs along the path shown as a bold solid line in FIG. 3 and is laid on top of the tape T at platen roller 74. The ink ribbon R passes along the inner side of through hole 71 and is wound around ribbon winding roller 75.

Printing occurs at platen roller 74 where the tape T comes to lie on top of the ribbon R. A window 71*a* is formed on the side wall of through hole 71 which faces platen roller 74. An axle insertion hole 72*a* for positioning is formed at the center of tape roller 72; a roller drive axle insertion hole 74*a*, at the center of platen roller 74; and another roller drive axle insertion hole 75*a*, at the center of ribbon winding roller 75.

The front surface of tape T is used for printing and its back side is coated with an adhesive layer which is covered with peel-off tape. Thus, one can stick the printed tape at any place desired by removing the peel-off tape. The printers of the present embodiment are designed to accommodate a tape cartridge containing a tape of either 6, 9, 12, 18, or 24 mm in width.

Tape cartridge compartment 8 for accommodating the tape cartridge has a head unit 12 including a thermal head 11 therein, an axle 13 for positioning, a platen roller drive axle 14, and a ribbon roller drive axle 15 projecting from the bottom of the compartment. When tape cartridge 7 is inserted, the above components mate with through hole 71, tape roller axle insertion hole 72*a*, platen roller drive axle insertion hole 74*a*, and ribbon roller drive axle insertion hole 75*a*. With tape cartridge 7 inserted, heat elements 11*a*, arranged in a vertical array on the thermal head surface 11, face the tape T and the ribbon R which run on platen roller 74 through window 71*a* on tape cartridge insertion through hole 71. Thermal head 11 can rotate from the print position shown in a solid line in FIG. 3 to the release position shown in a fictitious outline and vice versa. In the present embodiment, when cover 4 is closed, a projection 4*e* formed on the back of cover 4 activates a mechanism (not shown) so that the thermal head moves from the release position to the print position shown in the solid line. Further, pushing open cover button 6 allows thermal head 11 to move back to the release position.

Case 2 includes a tape exit 16 which corresponds to tape exit 76 on inserted tape cartridge 7. The tape T comes out of the printer through both tape exit 76 on the cartridge and tape exit 16 on the case. A cutter (not shown) is included at the tape exit 16, where the tape is cut when a cutter button 17, arranged behind tape exit 16, is pushed down. The mechanism for the cutter is the same as that in the conventional tape printer.

Case 2 also includes a circuit board which controls the operation of each component of the printer, a stepping motor which drives the driving members such as the platen roller, the ribbon winding roller, etc., and a battery compartment as mentioned earlier.

Figure 4:
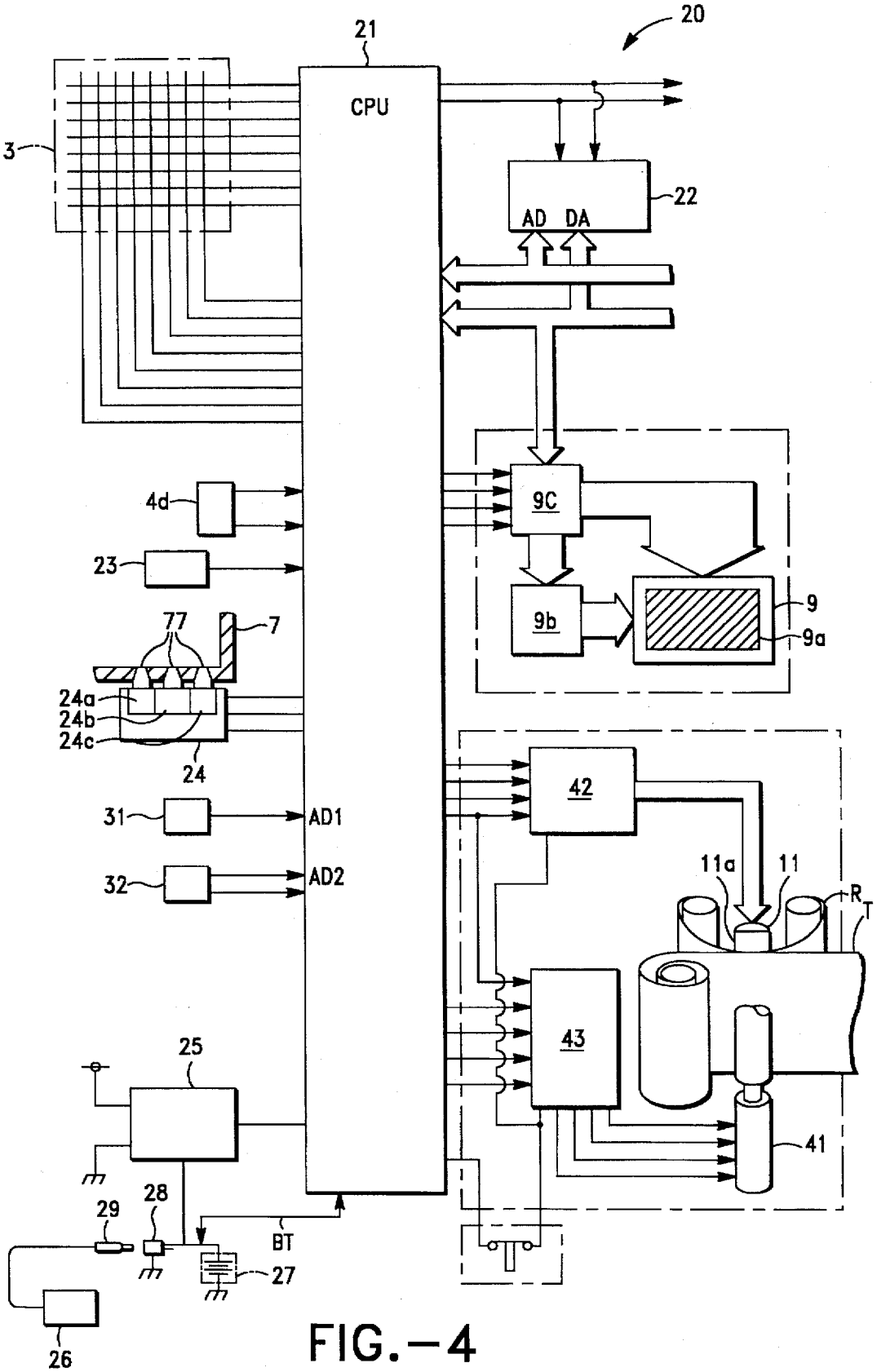
FIG. 4 is a schematic block diagram showing the control system of the tape printer according to the present invention.

Next, the control system employed in the printer of the present embodiment is described with reference to FIG. 4. The critical component of the control system is a control circuit 20. The control circuit comprises a one-chip microcomputer (CPU) 21, a mask ROM 22, and various circuits which interface CPU 21 with the peripheral circuits. Keyboard 3 and liquid crystal display 9 are coupled, directly or indirectly through interfaces, to CPU 21 and controlled by CPU 21.

A power switch 4*d* and a cover status detection switch 23 for detecting whether the cover is dosed or open are connected to the input ports of CPU 21. A discrimination switch 24 is also connected to CPU 21. Discrimination switch 24 is arranged in one of the bottom corners of cartridge compartment 8. Discrimination switch 24 has three identification switches 24*a*, 24*b*, and 24*c* which fit into the three tape identification holes 77 formed on the case of tape cartridge 7. The identification switch generates an "on" signal when the projection of the switch is large, while it generates an "off" signal when the projection is small. Tape cartridges 7 have different combinations of tape identification hole depths (deep or shallow) which vary according to the width of the tape T the tape cartridges contains. Therefore, the output of discrimination switch 24 indicates the tape width contained in the inserted tape cartridge 7. The heat elements of the thermal head are driven differently according to the tape width as described below.

The numeral 25 denotes a power unit. Either an AC adapter 26 or a battery 27 supplies the DC power to the power unit. The input terminals for the DC current are a plug 28, and the power from AC adapter 26 is supplied by inserting a jack 29. The insertion of jack 29, with the aid of the break contacts, breaks the connection of battery 27 with power unit 25. Plug 28 has another contact through which the signal BT is provided to CPU 21.

Based on the BT signal, CPU 21 determines whether the power is supplied by AC adapter 26 or battery 27. The present embodiment employs different print controls depending on the power supply type.

The print density generated by thermal head 11 is a function of the duration of the current signal provided to heat elements 11*a*, the drive voltage, and the ambient temperature. In the present embodiment, a temperature measuring circuit 31 and a voltage measuring circuit 32 measure the ambient temperature and the drive voltage, respectively. The outputs of circuits 31 and 32 are provided to analog/digital (A/D) conversion input ports AD1 and AD2, respectively. CPU 21 converts the input voltages into the digital values and uses them to control the system as shown below.

Figure 5:
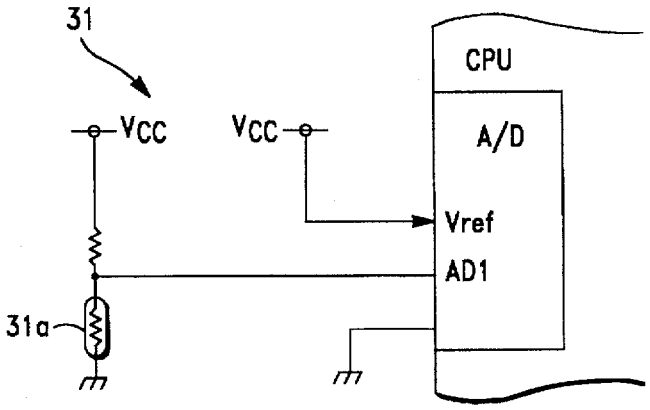
FIG. 5 is a schematic diagram of the temperature measuring circuit.

Temperature measuring circuit 31 of the present embodiment utilizes a thermistor 31*a* as a temperature sensor as shown in FIG. 5. The voltage difference between the two terminals of the thermistor is supplied to the A/D conversion input port AD1. The reference voltage for the A/D conversion is common to the driving voltage Vcc for the thermistor. As a result, even if the voltage drops after switching to the battery operation mode, the reference voltage changes accordingly. Therefore the temperature is measured accurately with thermistor 31*a* regardless of the variation in battery voltage.

Figure 6:
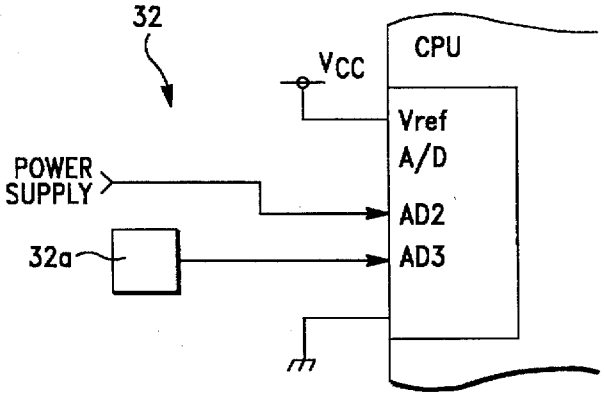
FIG. 6 is a schematic diagram of the voltage measuring circuit.

Voltage measuring circuit 32 shown in FIG. 6 includes a constant voltage generating circuit 32*a* which generates a constant voltage when operating within the range of the operation voltages. The generated constant voltage V0 is input to the A/D conversion input port AD3 of CPU 21. The reference voltage Vref for the A/D conversion is the same as the driving voltage Vcc as mentioned above. Even if the voltage of battery 27 drops and the driving voltage Vcc changes, the power supply voltage can be measured accurately by referring to the constant voltage V0 applied to input port AD3 and adjusting the measured voltage accordingly. Thus the present embodiment allows for an accurate measurement of the power supply voltage even when a battery is used as the power supply.

Mask ROM 22 stores various character fonts and is coupled to CPU 21 by means of the address bus and the data bus. Liquid crystal display 9 comprises display screen 9*a*, a driver for display screen 9*a*, and a driver controller for controlling driver 9*b*.

The print mechanism of the printer of the present embodiment comprises thermal head 11 and stepping motor 41 as primary mechanical elements. It also includes a printer controller 42 and a motor driver 43 as primary controlling elements. Thermal head 11 of the present embodiment has 128 heat elements 11*a* arranged in a vertical array with a fixed interval. The rotation angle of stepping motor 41 is determined by the phases of the four signals. The tape length advanced with a single step of stepping motor 41 can be adjusted by the reduction mechanism arranged in the case between the stepping motor and the platen roller drive axle. The tape is advanced by driving stepping motor 41 through a fixed number of steps in synchronization with the printing of a one-dot column.

The internal ROM of CPU 21 stores various control programs for driving and controlling the peripheral circuits descibed above. Executing these programs controls the operation of the system.

Figure 7:
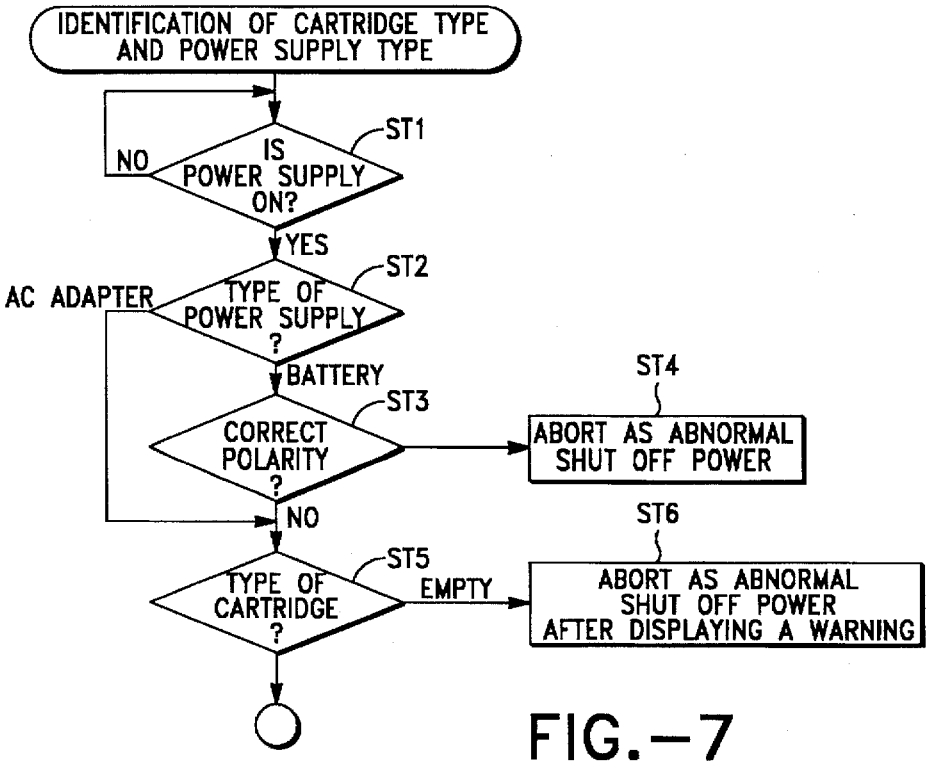
FIG. 7 is a flow chart of the operation for identifying the type of the inserted cartridge and the type of the power supply used.

Next, the printer operation of the present embodiment is described below. First, FIG. 7 shows a flow chart for identifying the type of the operating power supply and the type of the inserted tape cartridge. Once power switch 4*d* is activated (Step ST1), the printer determines whether the power supply is AC adapter 26 or battery 27 based upon the signal BT which carries the identification signal (Step ST2). The results obtained in the above steps as well as the results to be obtained in the following steps are stored in the working register area of the internal RAM of CPU 21. If the power supply is a battery, the printer checks to determine whether the battery is installed with the correct polarity (Step ST3). If the printer finds that the polarity is wrong, it detects that an anomaly has occurred, shuts off the power, and finishes the operation (Step ST4). Next, the type of inserted tape cartridge 7 is determined from the signals of discrimination switches (Step ST5). In the present embodiment, there are five types of tape cartridges 7 of different widths. If a tape cartridge is not found there, a warning for abnormal operation is displayed on liquid crystal display screen 9*a*, the power is shut off, and the operation ceases (Step ST6). Thus, the type of power supply used and the type of inserted cartridge are determined.

Figure 8:
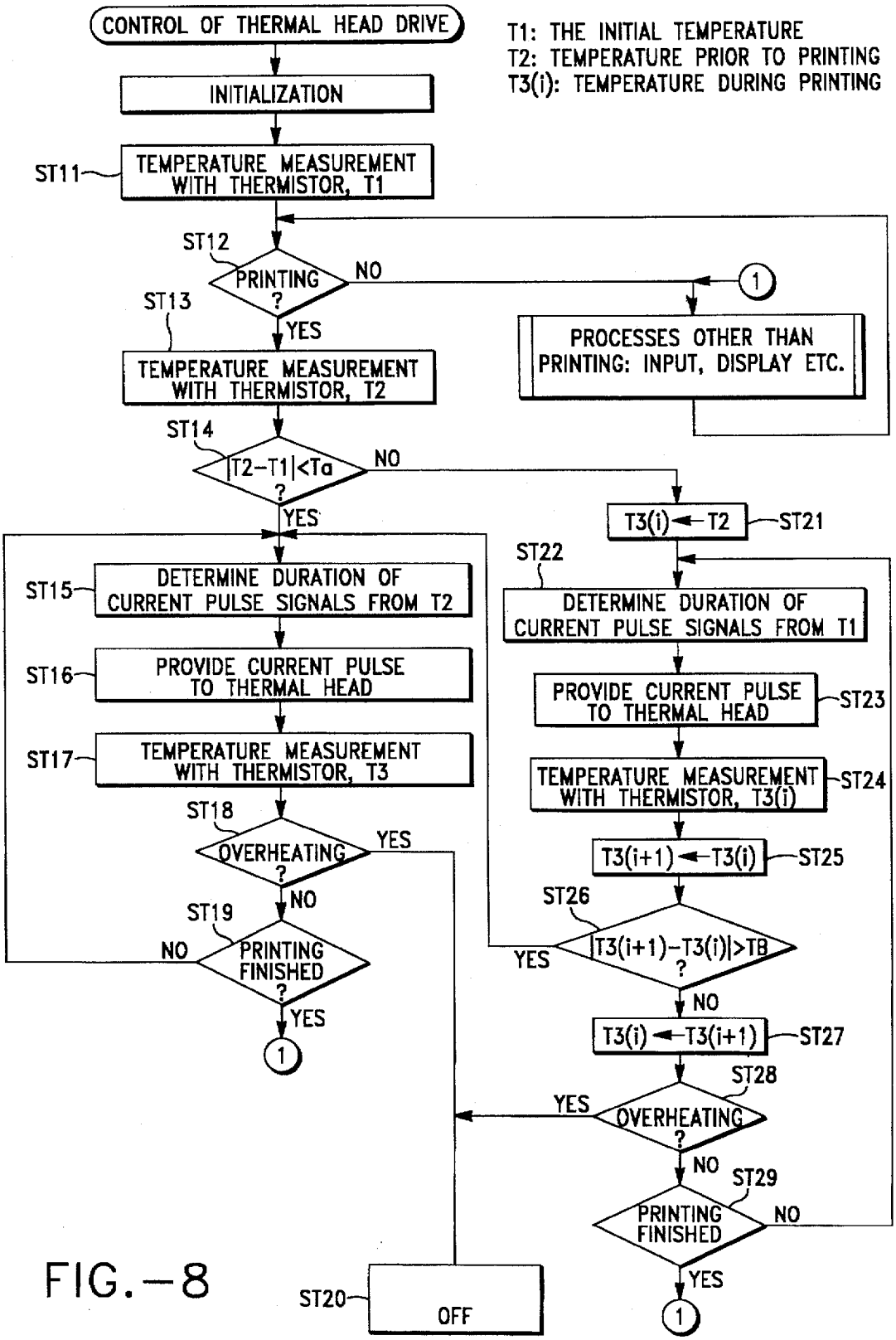
FIG. 8 is a flow chart of the operation for controlling the thermal head drive.

FIG. 8 shows the flow chart for controlling the duration of the current signal provided to the heat elements of the thermal head depending upon the ambient temperature of thermal head 11. In the present embodiment, the ambient temperature of the thermal head is measured immediately after power is switched on, and the measured temperature is referred to as T1. When the print command is issued, the ambient temperature of the thermal head is measured just before the printing starts, and this temperature is referred to as T2. After printing starts, the ambient temperature of thermal head 11 is measured every time a one-dot line is printed, and the measured temperature is referred to as T3(i) (i is a positive integer). As the measured temperature changes, the duration of the current signal provided to the heat elements of thermal head 11 is changed.

Next, the steps for the signal duration control are described below. First, the initialization, described with reference to FIG. 7, is performed after the power is switched on. Then, the initial temperature T1 of thermal head 11 is measured based on the signal from temperature measuring circuit 31 (Step ST11) and the operation awaits a print command (Step ST12). When the print command is issued, the temperature T2 is measured just before printing begins (Step ST13). Next, the difference between T1 and T2 is computed and compared with a predetermined value Ta to determine whether the difference is greater or less than Ta (Step ST14).

Generally, the temperature of the environment does not change much between the time the power is switched on and the time just before printing begins. Typically the temperature difference is less than about 5° C. Therefore, if, for example, Ta is set at 5° C. and if the temperature difference is less than Ta, the temperature T2 is considered to be the ambient temperature of thermal head 11.

In this case, a loop made with Step ST15 through Step ST19 is executed. That is, the pulse duration provided to heat elements 11*a* of thermal head 11 is determined for the temperature T2 in order to form printed dots of the appropriate density. On each printing, i.e., on each pulse applied to thermal head 11, the temperature is measured and stored as T3 (i). If T3 (i) is higher than the temperature which indicates the overheating of thermal head 11, the printer detects that an anomaly has occurred, aborts the operation, and shuts off the power (Step ST18–ST20).

The temperature which defines the overheat of the thermal head in steps ST18 and ST28 described below must be determined so that there can be no damage to the thermal head; there can be no adverse effect to the case or other components near the thermal head; and there can be no danger of being burned even when fingers touch the thermal head. The typical preferred temperature is about 70° C.

If the difference between the temperatures T1 and T2 is more than Ta, thermal head 11 is considered to have been heated up in the previous printing operations and the ambient temperature is believed to have been affected by the heated thermal head. In this case the ambient temperature is set at the initial temperature T1 and the pulse duration is determined for that temperature. In other words, the operation moves to step ST21 from step ST14 where the temperature T2 is stored as T3 (i). Then the pulse duration applied to thermal head 11 is determined for the initial temperature T1 (steps ST22 and ST23). Next, the temperature measurement is performed (step ST24) and the measured temperature is stored as T3 (i+1) (step ST25).

Thus in the case in which the difference between temperatures T1 and T2 is larger than Ta, the signal duration is determined by the initial temperature T1. The thermal head is heated through repetitive printings and may overheat. That is, if the currently measured temperature T3 (i+1) is higher than the temperature T3 (i) measured during the previous printing by the predetermined temperature Tb, thermal head 11 must not be heated further. The typical value for Tb is about 1° C.

In the present embodiment, if thermal head 11 increases in temperature excessively over the previous printing, the operation moves from step ST26 to step ST15, wherein the signal duration to thermal head 11 is determined for the preprinting temperature T2. Typically, since the temperature T2 is higher than the initial temperature T1, the signal duration determined for T2 is smaller than that for T1. As a result, the energy applied to thermal head 11 is reduced and this prevents the thermal head from overheating.

When thermal head 11 overheats after gradually accumulating heat on each printing, the operation detects it from the temperature ST3 (i) in step ST28, aborts the printing, and shuts off the power (step ST20).

In the present embodiment, the initial temperature T1 is stored for a specified period of time even after the power is shut off (not shown in FIG. 8). The reason for this is as follows: if the power is switched back on within too short a time after being shut off following a series of printings, thermal head 11 may not have been cooled down sufficiently. Hence the new initial temperature T1 measured after the power is on does not represent the real ambient temperature of thermal head 11. Therefore, in the present embodiment the initial temperature T1 is stored for a specified period of time after the power is shut off during which thermal head 11 can sufficiently cool down. For this purpose an EPROM may be used as a memory means. Thus, when the power is put back on within five minutes, for example, the stored temperature T1 is used for the new initial temperature. If the printer has an automatic power shut-off feature, the initial temperature can be cleared when the power is shut off by this feature.

Figure 9:
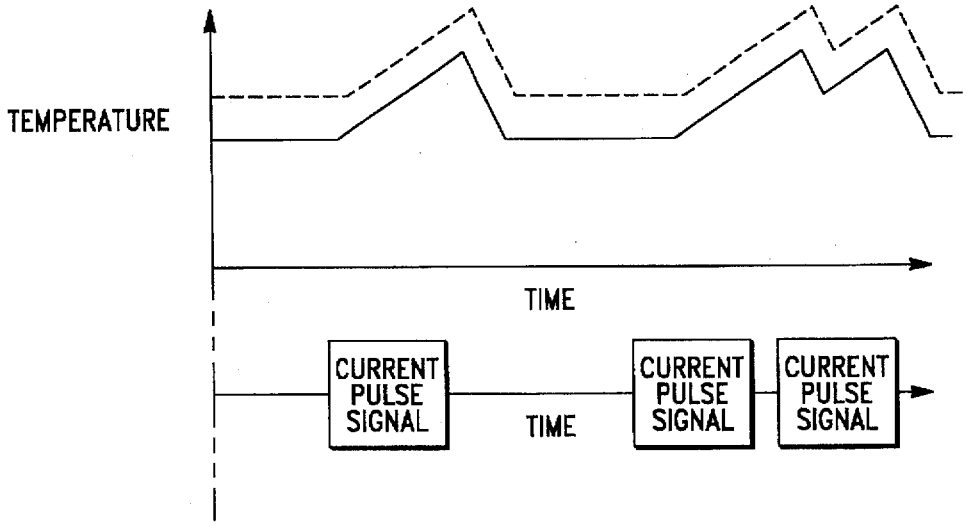
FIG. 9 shows the temporal temperature change of the heat elements of the thermal head when current signals are applied to them.
Figure 10:
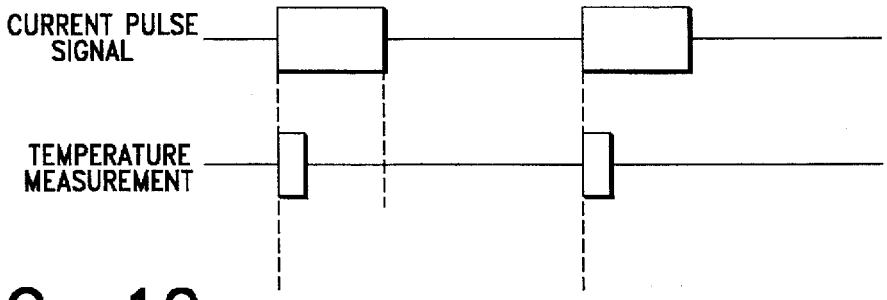
FIG. 10 shows the timing of measurement of the temperature during printing.

The timing for measuring the temperature T3 (i) during the above control operation is described below. FIG. 9 shows the temperature change of a heat element of thermal head 11 when pulses are applied to the thermal head. The change depends on the temperature of the heat element before the pulse is applied. Therefore, it is desirable to measure the temperature immediately after the pulse is applied as shown in FIG. 10 in order to control the heat generation of the heat element of the thermal head.

Other printing control operations

Figure 11A:
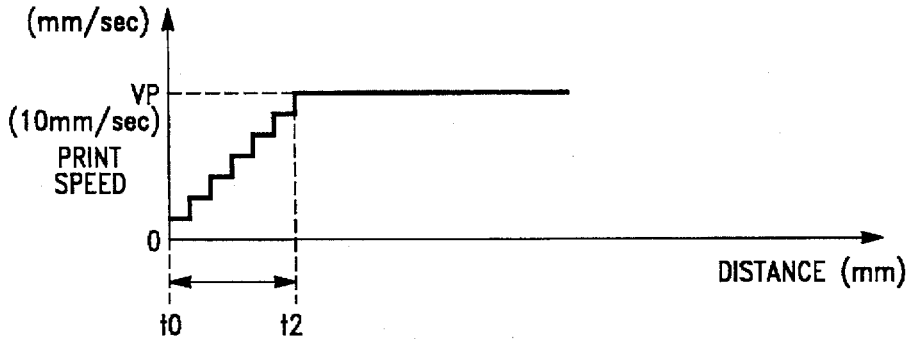
FIGS. 11A–11C show the methods for accelerating the stepping motor.

Printer 1 of the present embodiment can start printing before the tape speed becomes constant. In other words, because the printing begins while the stepping motor for tape transportation is being accelerated toward the constant print speed, that portion of the tape that is normally wasted can now be saved. In the conventional scheme, when stepping motor 41 starts, it is accelerated to a constant speed in several steps to avoid an irregular operation as shown in FIG. 11A. The constant speed, referred to as Vp, is a print speed and typically 10 mm/sec. The stepping motor, for example, receives a signal to start at the time t0, and is accelerated in five steps to reach the print speed of 10 mm/sec at the time t2 when the printing actually starts. Since the tape starts running at the time t0, the amount of tape advanced during the time period between t0 and t2 is wasted.

Figure 11B:
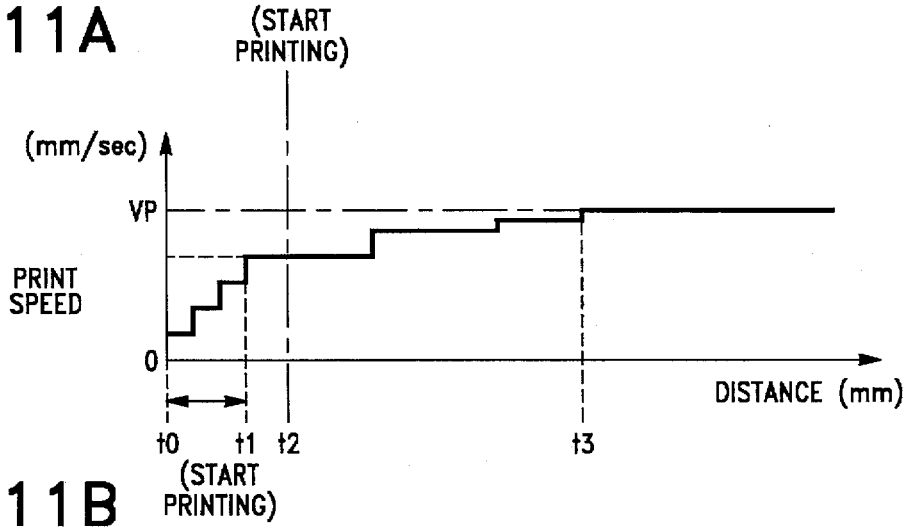

As shown in FIG. 11B, printer 1 of the present embodiment starts actual printing at the time t1 before the constant print speed is reached. The motor speed at the time t1 is Vp1, which is slower than Vp. In the present embodiment, after the actual printing starts, the acceleration is set lower than that prior to printing so that the constant print speed Vp is reached at the time t3 which is later than t2. Since the acceleration is set low when the actual printing starts, the printed dots are not deformed. In other words, the acceleration is set so low that the print quality is not degraded. As a result the amount of tape advanced before the real printing (time t1) is less than that of the conventional scheme and hence less amount of paper is wasted in the present embodiment.

Figure 11C:
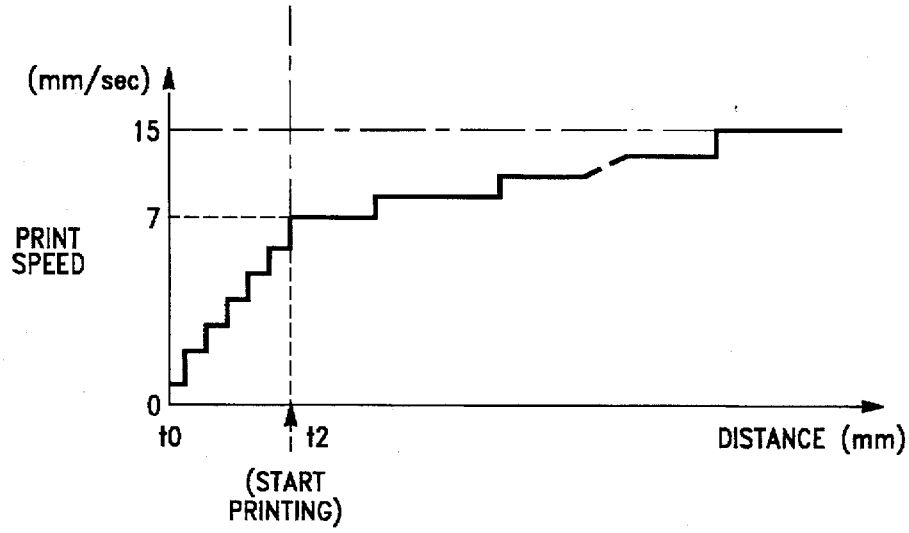

The print speed Vp can be higher, for example 15 mm/sec, than the conventional print speed of 10 mm/sec. In this case, however, acceleration of the motor in five steps may induce an irregular operation of the motor, giving rise to a degradation of the print quality. A solution to this problem is to increase the number of steps. If the motor is gradually accelerated to the higher print speed, a long time is required before it reaches the print speed. Much paper is wasted. Since printing can start while the motor is being accelerated in the present embodiment, it is possible for the motor to be accelerated first in the conventional way as shown in FIG. 11C, then printing starts at the time t2, and the motor is accelerated slowly after the time t2. This scheme results in the same amount of wasted tape as the conventional scheme. Thus the present embodiment allows for faster printing while consuming the same amount of wasted tape at the start of printing as does the slower conventional printer.

Similarly, printing can also occur as the motor is decelerating to finish printing. There is no degradation of print quality if the deceleration during printing is sufficiently small.

Next, the print controls of the present embodiment during the use of battery 27 as the power source are described below. Since a battery has a limited capacity, low-power print controls are highly desirable. In the present embodiment different thermal head drive schemes and print speeds (tape speeds) are used for different types of tape cartridges 7.

The thermal head drive scheme for a narrow tape is that all dots of the column are printed at the same time. In the present embodiment thermal head 11 has 128 heat elements 11*a* arranged in a vertical array and it can be used for tapes of up to 24 mm in width. Therefore, for a tape of 6 mm in width, the narrowest, only a part of the 128 heat elements are used for printing a column of dots at the same time. For a tape of 24 mm in width, however, all the 128 heat elements may be activated at the same time. The drive current is proportional to the number of heat elements active at any one time. Therefore, a higher current is needed to print on a wider tape. In order to keep the drive current low one can print a column of dots either at one time or multiple times according to the tape width as shown in FIG. 12.

For tapes of 6 mm and 9 mm in width, all the necessary heat elements to print the column of dots are driven at the same time. However, for tapes of 12 mm and 18 mm in width, the number of the heat elements necessary to print the column is more, so the elements are divided into two groups which are driven alternately. For example, in the first run, the odd-numbered of the 128 heat elements counting from the top are activated, while, in the next run, the even numbered heat elements are activated. For printing on the widest tape of 24 mm in width, all the 128 heat elements are used to print the column of dots. In this case, the column is printed with three groups of heat elements. In the initial run, the first heat element and every third element thereafter are on; in the second run, the second heat element and every third element thereafter come on; and, in the third run, the third heat element and every third element thereafter are on.

Driving the heat elements in separate groups keeps the drive current low and allows a battery of a limited capacity to be used for print control.

In the present embodiment, the print speed (tape speed) is changed according to the tape width as shown in FIG. 12. The differences in the print speed reflect the differences in the driving scheme of heat elements 11*a* of thermal head 11 as described above. The print speed for narrower tapes is faster while that for wider tapes is slower. In the present embodiment, the print speed for the tapes of 6 mm, 9 mm, and 12 mm in width is 15 mm/sec whereas the print speeds for the tapes of 18 mm and 24 mm in width are 10 mm/sec and 7 mm/sec, respectively. Thus, changing the drive scheme according to the tape width allows the printer to print at the different and more appropriate print speed as dictated by varing conditions.

Different drive energy may be provided to the thermal head depending on the tape width. The technique of changing the drive scheme according to the tape width can also be used when the power is supplied by the AC adapter rather than the battery.

When battery 27 is used for the power supply and still has the rated voltage, printing is performed at a speed dependent upon the tape width as shown in FIG. 12. However, when voltage measuring circuit 32 senses a drop in battery voltage Vd, the printing operation is switched to a low power print mode in which the print speed is reduced.

FIG. 13 shows the print speeds as being dependent upon the voltage Vd and the tape width. When the voltage Vd is higher than the switch voltage A, the print speeds are the same as shown in FIG. 12. When the voltage Vd is lower than A but higher than the value B, the highest speed is reduced to 10 mm/sec. When the voltage Vd drops further below the value B but stays above the operable voltage C, all the speeds are reduced to the slowest speed of 7 mm/sec.

Switching to the low power operations as the battery voltage drops prevents the battery from wearing out too soon. It also prevents any degradation of the print quality due to a fluctuation in the print speed as caused by insufficient driving power to the motor and the resultant irregular motor motion.

In the present embodiment a voltage converter is not used for the battery operation, and the source voltage is applied directly to the stepping motor to drive it. Excluding a voltage converter thus contributes to saving power because there is no power loss there. In this case, however, since the battery voltage varies as the battery is used, the voltage rating of the motor must be set at a value lower than that of a new battery. This rating causes a problem when a new battery is used, because, in this case, excessive driving energy is applied to the motor.

In order to overcome this drawback, the present embodiment monitors the power supply voltage using voltage measuring circuit 32. Pulse width modulation, depending on the measured voltage, is performed on the pulse signals for driving the motor and thus the appropriate drive energy is always applied to the motor.

Figure 14:
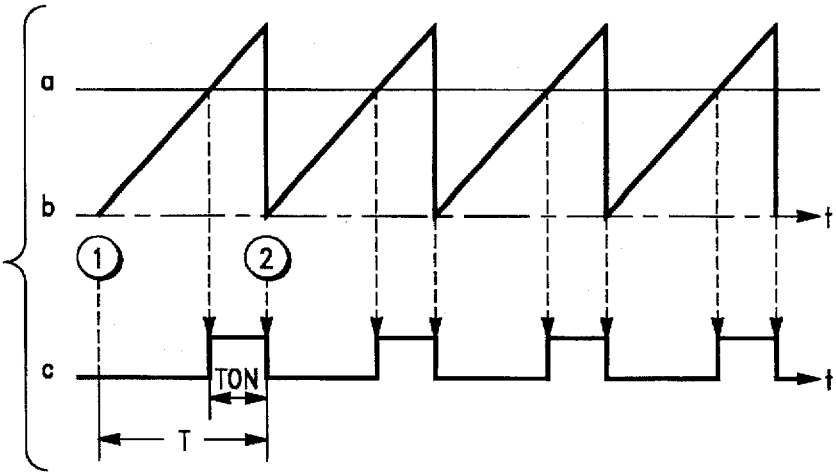
FIG. 14 shows the pulse width modulation for the pulse signals for driving the stepping motor.

An example of the pulse width modulation of the motor driving pulse signals is described with reference to FIG. 14. First, saw-tooth signals b of a fixed period are generated as shown in FIG. 14. These signals may be generated by software and the timer included in CPU 21. Next, a threshold voltage a in the figure is determined according to the measured voltage. The threshold is determined every time printing is performed. Shifting the threshold voltage changes the pulse width or the duty ratio (Ton/T) of the motor driving pulse signals c in the figure. The duty ratio is small when the power supply voltage is high, whereas it is large when the power supply voltage is low. As a result a constant driving energy is supplied to stepping motor 41.

The embodiments mentioned above are examples of the applications of the present invention for driving the thermal head of a tape printer. It is understood that the present invention is also applicable to other types of printers than tape printers.

As described above, according to the present invention, the ambient temperature of the thermal head is measured when the power is switched on and immediately before printing starts. One of the measured temperatures that is least affected by the heat radiation of the thermal head is used to control the driving of the thermal head. Thus, the present invention utilizes a single temperature sensor to determine the ambient temperature not affected by the heat generation of the thermal head and properly controls the current signal duration provided to the heat elements of the thermal head.

While the invention has been described in conjunction with several specific embodiments, it is evident to those skilled in the art that many further alternatives, modifications and variations will be apparent in light of the foregoing description. Thus, the invention described herein is intended to embrace all such alternatives, modifications, applications and variations as may fall within the spirit and scope of the appended claims.

What is claimed is:

1. A method for driving and controlling a thermal head of a printing device, said thermal head including a plurality of heat elements to which current signals are supplied, the method comprising the steps of:

(a) measuring an ambient temperature of said thermal head to obtain an initial temperature T1 immediately after the power to the printing device is switched on;

(b) measuring an ambient temperature of said thermal head to obtain a temperature prior to printing T2 just before said thermal head starts printing on a recording medium;

(c) calculating a temperature difference between the initial temperature T1 and the temperature prior to printing T2; and (d) if the temperature difference is less than a predetermined first threshold value Ta, controlling the duration of the current signals provided to the heat elements of said thermal head in accordance with the temperature prior to printing T2.

2. The method of claim 1, further comprising the steps of:

(e) measuring the ambient temperature of said thermal head each time said thermal head prints on the recording medium to obtain a temperature during printing T3(i), with i being a positive integer; and (f) if the temperature during printing T3(i) exceeds a predetermined value Tc, aborting printing operation.

3. The method of claim 2, further comprising the step of:

(g) storing the initial temperature T1 for a predetermined period of time after the power to the printing device is turned off.

4. The method of claim 3, wherein the ambient temperature of said thermal head is measured by a measuring means that comprises a thermistor as a temperature sensor and an A/D converter for measuring the output voltage of the thermistor and the measuring means uses a common voltage for both the drive voltage of the thermistor and the reference voltage for the A/D converter.

5. The method of claim 1, further comprising the step of:

(e) if the temperature difference exceeds the predetermined first threshold value Ta, controlling the duration of the current signals provided to the heat elements of said thermal head in accordance with the initial temperature T1.

6. The method of claim 5, further comprising the steps of:

(f) measuring the ambient temperature of said thermal head each time said thermal head prints on the recording medium to obtain a temperature during printing T3(i);

(g) calculating a temperature difference between a temperature during printing T3(i+1) and the temperature during printing T3(i) which was measured during a previous printing; and (h) if the temperature difference exceeds a predetermined value Tb, controlling the duration of the current signals provided to the heat elements of said thermal head in accordance with the temperature prior to printing T2.

7. The method of claim 6, further comprising the step of:

(i) if the temperature during printing T3(i) exceeds the predetermined value Tc, aborting printing operation.

8. The method of claim 7, further comprising the step of:

(j) storing the initial temperature T1 for a predetermined period of time after the power to the printing device is turned off.

9. The method of claim 8, wherein the ambient temperature of said thermal head is measured by a measuring means that comprises a thermistor as a temperature sensor and an A/D converter for measuring the output voltage of the thermistor and the measuring means uses a common voltage for both the drive voltage of the thermistor and the reference voltage for the A/D converter.

10. An apparatus for driving and controlling a thermal head of a printing device, said thermal head including a plurality of heat elements to which current signals are supplied, the apparatus comprising:

means for measuring an ambient temperature of said thermal head to obtain an initial temperature T1 immediately after the power to the printing device is switched on, and for measuring an ambient temperature of said thermal head to obtain a temperature prior to printing T2 just before said thermal head starts printing on a recording medium;

means for calculating a temperature difference between the initial temperature T1 and the temperature prior to printing T2; and control means for controlling the duration of the current signals provided to the heat elements of said thermal head, said control means controlling the duration of the current signals in accordance with the temperature prior to printing T2 if the temperature difference is less than a predetermined first threshold value Ta.

11. The apparatus of claim 10, wherein said measuring means measures the ambient temperature of said thermal head each time said thermal head prints on the recording medium to obtain a temperature during printing T3(i), with i being a positive integer; and the apparatus further comprises means for aborting printing operation, said aborting means aborting the printing operation if the temperature during printing T3(i) exceeds a predetermined value Tc.

12. The apparatus of claim 11, further comprising means for storing the initial temperature T1 for a predetermined period of time after the power to the printing device is turned off.

13. The apparatus of claim 12, wherein said measuring means comprises a thermistor as a temperature sensor and an A/D converter for measuring the output voltage of the thermistor, and said measuring means uses a common voltage for both the drive voltage of the thermistor and the reference voltage for the A/D converter.

14. The apparatus of claim 10, wherein, if the temperature difference exceeds the predetermined first threshold value Ta, said control means controls the duration of the current signals provided to the heat elements of said thermal head in accordance with the initial temperature T1.

15. The apparatus of claim 14, wherein said measuring means measures the ambient temperature of said thermal head each time said thermal head prints on the recording medium to obtain a temperature during printing T3(i);

said calculating means calculates a temperature difference between a temperature during printing T3(i+1) and the temperature during printing T3(i) which was measured during a previous printing; and if the temperature difference exceeds a predetermined value Tb, said control means controls the duration of the current signals provided to the heat elements of said thermal head in accordance with the temperature prior to printing T2.

16. The apparatus of claim 15, further comprising means for aborting printing operation, said aborting means aborting the printing operation if the temperature during printing T3(i) exceeds the predetermined value Tc.

17. The apparatus of claim 16, further comprising means for storing the initial temperature T1 for a predetermined period of time after the power to the printing device is turned off.

18. The apparatus of claim 17 wherein said measuring means comprises a thermistor as a temperature sensor and an A/D converter for measuring the output voltage of the thermistor and said measuring means uses a common voltage for both the drive voltage of the thermistor and the reference voltage for the A/D converter.

19. A printing device, comprising:

a thermal head having a plurality of heat elements;

drive means for providing current signals to said heat elements of said thermal head; and means for driving and controlling said thermal head, comprising:

means for measuring an ambient temperature of said thermal head to obtain an initial temperature T1 immediately after the power to the printing device is switched on, and for measuring an ambient temperature of said thermal head to obtain a temperature prior to printing T2 just before said thermal head starts printing on a recording medium, means for calculating a temperature difference between the initial temperature T1 and the temperature prior to printing T2, and control means for controlling the duration of the current signals provided to the heat elements of said thermal head, said control means controlling the duration of the current signals in accordance with the temperature prior to printing T2 if the temperature difference is less than a predetermined first threshold value Ta.

20. The printing device of claim 19, wherein said measuring means measures the ambient temperature of said thermal head each time said thermal head prints on the recording medium to obtain a temperature during printing T3(i), with i being a positive integer; and the printing device further comprises means for aborting printing operation, said aborting means aborting the printing operation if the temperature during printing T3(i) exceeds a predetermined value Tc.

21. The printing device of claim 20, further comprising means for storing the initial temperature T1 for a predetermined period of time after the power to the printing device is turned off.

22. The printing device of claim 21, wherein said measuring means comprises a thermistor as a temperature sensor and an A/D converter for measuring the output voltage of the thermistor, and said measuring means uses a common voltage for both the drive voltage of the thermistor and the reference voltage for the A/D converter.

23. The printing device of claim 19, wherein, if the temperature difference exceeds the predetermined first threshold value Ta, said control means controls the duration of the current signals provided to the heat elements of said thermal head in accordance with the initial temperature T1.

24. The printing device of claim 23, wherein said measuring means measures the ambient temperature of said thermal head each time said thermal head prints on the recording medium to obtain a temperature during printing T3(i);

said calculating means calculates a temperature difference between a temperature during printing T3(i+1) and the temperature during printing T3(i) which was measured during a previous printing; and if the temperature difference exceeds a predetermined value Tb, said control means controls the duration of the current signals provided to the heat elements of said thermal head in accordance with the temperature prior to printing T2.

25. The printing device of claim 24, further comprising means for aborting printing operation, said aborting means aborting the printing operation if the temperature during printing T3(i) exceeds the predetermined value Tc.

26. The printing device of claim 25, further comprising means for storing the initial temperature T1 for a predetermined period of time after the power to the printing device is tuned off.

27. The printing device of claim 26 wherein said measuring means comprises a thermistor as a temperature sensor and an A/D converter for measuring the output voltage of the thermistor and said measuring means uses a common voltage for both the drive voltage of the thermistor and the reference voltage for the A/D converter.

* * * * *

UNITED STATES PATENT AND TRADEMARK OFFICE

CERTIFICATE OF CORRECTION

PATENT NO. : 5,690,437
DATED : November 25, 1997
INVENTOR(S) : Shigekazu Yanagisawa, et al.

It is certified that error appears in the above-identified patent and that said Letters Patent is hereby corrected as shown below:

Title page, item 57, Abstract, line 26, insert --ambient-- after "head".

Column 16, line 6, change "tuned" to --turned--.

Signed and Sealed this

Twenty-second Day of December, 1998

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,690,437
DATED : November 25, 1997
INVENTOR(S) : Shigekazu Yanagisawa, et al.

It is certified that error appears in the above-identified patent and that said Letters Patent is hereby corrected as shown below:

Title page, item 73, Assignee, insert --King Jim Co., Ltd., Tokyo, Japan--.

Signed and Sealed this

Sixth Day of July, 1999

*Attest:*

Q. TODD DICKINSON

*Attesting Officer*

*Acting Commissioner of Patents and Trademarks*